US007374623B2

(12) United States Patent
Marchionni et al.

(10) Patent No.: US 7,374,623 B2
(45) Date of Patent: May 20, 2008

(54) METALLURGICAL PRODUCT OF CARBON STEEL, INTENDED ESPECIALLY FOR GALVANIZATION, AND PROCESSES FOR ITS PRODUCTION

(75) Inventors: Christian Marchionni, Rosselange (FR); Yann Le Papillon, Marange Silvange (FR); Alain Leclercq, Paris (FR); Michel Faral, Metz (FR); Jean-Michel Damasse, Rome (IT); Philippe Rocabois, Metz (FR)

(73) Assignee: USINOR, Puteaux (FR)

( * ) Notice: Subject to any disclaimer, the term of this patent is extended or adjusted under 35 U.S.C. 154(b) by 0 days.

(21) Appl. No.: 10/323,886

(22) Filed: Dec. 20, 2002

(65) Prior Publication Data

US 2003/0116232 A1 Jun. 26, 2003

(30) Foreign Application Priority Data

Dec. 24, 2001 (FR) ..... 01 16831

(51) Int. Cl.
*B32B 15/00* (2006.01)
*C22C 38/00* (2006.01)

(52) U.S. Cl. ..... 148/541; 148/320

(58) Field of Classification Search ..... 148/533, 148/541, 320

See application file for complete search history.

(56) References Cited

U.S. PATENT DOCUMENTS

| | | | | | |
|---|---|---|---|---|---|
| 3,769,004 | A | * | 10/1973 | Barnhardt et al. | 75/546 |
| 3,793,000 | A | * | 2/1974 | Miltenberger | 75/508 |
| 3,988,174 | A | | 10/1976 | Kawano | |
| 4,014,683 | A | * | 3/1977 | Miltenberger | 75/508 |
| 4,024,624 | A | | 5/1977 | Bassett, Jr. et al. | |
| 4,073,643 | A | * | 2/1978 | Kumai et al. | 75/508 |
| RE31,251 | E | * | 5/1983 | Nakasugi et al. | 148/541 |
| 4,746,361 | A | * | 5/1988 | Pielet et al. | 75/531 |
| 4,928,748 | A | * | 5/1990 | Guthrie et al. | 164/479 |
| 5,460,665 | A | | 10/1995 | Yasuhara et al. | |
| 6,767,415 | B1 | * | 7/2004 | Sardoy et al. | 148/320 |
| 2002/0174746 | A1 | * | 11/2002 | Gross et al. | 75/546 |

FOREIGN PATENT DOCUMENTS

| | | | | |
|---|---|---|---|---|
| EP | 0387786 | A2 | * | 9/1990 |
| EP | 578 221 | A1 | | 1/1994 |
| EP | 785 283 | A1 | | 7/1997 |
| EP | 792 942 | A1 | | 9/1997 |
| EP | 906 960 | A1 | | 4/1999 |
| JP | 361288016 | | * | 12/1986 |
| JP | 07266005 | A | * | 10/1995 |

* cited by examiner

*Primary Examiner*—Roy King
*Assistant Examiner*—Jessee Roe
(74) *Attorney, Agent, or Firm*—Sughrue Mion, PLLC

(57) ABSTRACT

A metallurgical product, made of carbon steel and to be galvanized, which is in the form of a strip or of a sheet obtained from a continuously cast intermediate product having the following composition by weight: $0.0005\% \leqq C \leqq 0.15\%$; $0.08\% \leqq Mn \leqq 2\%$; $Si \leqq 0.040\%$; $Al_{total} \leqq 0.010\%$; $Al_{soluable} \leqq 0.004\%$; $0.0050\% \leqq O_{total} \leqq 0.0500\%$; $P \leqq 0.20\%$; $S \leqq 0.10\%$; each of Cu, Cr, Ni, Mo, W, $Co \leqq 1\%$; each of Ti, Nb, V, $Zr \leqq 0.5\%$; each of Sn, Sb, $As \leqq 0.1\%$; $B \leqq 0.1\%$; $N \leqq 0.0400\%$; and the remainder being iron and impurities. Also, a process for obtaining a metallurgical intermediate product, which includes: producing in a ladle a liquid steel the composition of which is as above, and in which the dissolved oxygen content is maintained between 0.0050 and 0.0500% by the establishment of a chemical equilibrium between the metal and the ladle slag; and casting the steel on a continuous casting machine.

9 Claims, No Drawings

METALLURGICAL PRODUCT OF CARBON STEEL, INTENDED ESPECIALLY FOR GALVANIZATION, AND PROCESSES FOR ITS PRODUCTION

BACKGROUND OF THE INVENTION

The invention relates to metallurgy. More precisely, it relates to carbon steels of the type which are to undergo galvanization, that is to say the deposition of zinc on their surface by immersion of the product in a bath of liquid zinc. The product is then generally in the form of a running strip or of a sheet.

Carbon steels for galvanization are steels comprising not more than 0.15% carbon and from 0.08 to 2% manganese, as well as the alloying elements and impurities conventional in carbon steels. The various classes of steel for galvanization are distinguished essentially by their contents of deoxidizing elements.

So-called "class 3" steels have a silicon content of from 0.15 to 0.25%.

So-called "class 2" steels have a silicon content less than or equal to 0.040%.

So-called "class 1" steels have a silicon content less than or equal to 0.030%.

The production and continuous casting of class 3 steels do not give rise to particular problems because, as a result of their silicon content, that element controls the deoxidation of the liquid steel by forming oxidized inclusions with the dissolved oxygen (optionally in combination with manganese).

For that reason, CO formation within the liquid steel, which would be likely to cause rimming of the steel at the time of casting, is not observed.

The same does not apply in respect of class 1 and 2 steels. In their case, the silicon content is too low for that element to intervene in the deoxidation process. It is the carbon that controls the deoxidation, and this manifests itself in the formation and evolution of CO, rendering the steel "rimmed". This rimming has two disadvantages:

- on the one hand, during solidification of the steel, it often causes the appearance of "blowholes" in the central region of the product, that is to say pores corresponding to the location of pockets of gas present at the moment of solidification; however, this disadvantage can be overcome if the steel subsequently undergoes vigorous hot rolling, which will close the pores;
- on the other hand, if the rimming unexpectedly becomes too great, there is a risk of the steel overflowing from the ingot mold in which solidification is taking place.

This latter risk is especially to be feared when a steel is cast continuously on a machine of the conventional type having a cooled and oscillating bottomless ingot mold with fixed walls. If the steel present in the ingot mold overflows, it represents a danger to surrounding personnel and leads to serious damage to the casting machine.

For that reason, sheets and strips of class 1 and 2 steel are conventionally obtained from intermediate products which are:

- either cast not continuously but in ingots in a conventional ingot mold, because this process is more tolerant of possible rimming of the steel: filling of the ingot mold can be discontinued before it overflows if pronounced rimming is noted, and even the consequences of an overflow are never serious to the point of calling into question the smooth running of the steel works; the ingots are subsequently hot rolled to form slabs;
- or cast continuously in the form of slabs on conventional machines having a cooled oscillating bottomless ingot mold with fixed walls, but after addition to the steel of a relatively large amount of aluminum so that that element controls the deoxidation by forming solid alumina inclusions, thus preventing the formation of CO and, accordingly, rimming.

These two methods are not ideal, however. It is well known that casting in ingots is less productive than continuous casting and subsequently requires a larger number of hot rolling steps to obtain a product of a given thickness. With regard to deoxidation with aluminum, it is more costly in terms of alloying elements. In addition, the alumina inclusions must be removed as far as possible prior to the continuous casting step so that there is no risk of their blocking the nozzles of the distributor of the casting machine.

Aluminum inclusions can be made liquid by treatment with calcium, but this introduces an additional cost in terms of alloying elements. It is also necessary to prevent as far as possible atmospheric reoxidation during the continuous casting, in order to avoid the formation of new alumina inclusions which it will not be possible to remove before solidification and which will be found in the end product, whose mechanical properties they will impair. To that end, argon is injected into the nozzles introducing the steel into the ingot mold, which, again, increases the manufacturing cost. In addition, there is a risk of bubbles of argon becoming trapped at the time of solidification, which are liable to cause faults in the product.

It would, however, be valuable to manufacture class 1 and 2 steels for galvanization by a process that is as economical as possible, because such steels have the advantage of allowing higher rates of deposition of the galvanizing coating than class 3 steels. This advantage is scarcely noticeable when the galvanization is effected by unrolling a strip of steel in a bath of liquid zinc. On the other hand, when an isolated sheet is immersed in the bath of zinc, it is important for the quality of the product and the productivity of the installation that the deposition be as rapid as possible.

SUMMARY OF THE INVENTION

The object of the invention is to put steel makers in a position to propose for galvanization steel strips and sheets that correspond to the grades of classes 1 and 2 mentioned above and that are produced at minimal costs, that is to say are manufactured from continuously cast intermediate products, and comprise little or no aluminum.

To that end, the invention relates to a metallurgical product which is made of carbon steel and is to be galvanized, which metallurgical product is in the form of a strip or sheet that is obtained from a continuously cast intermediate product and is constituted by a steel having the following composition by weight:

- $0.0005\% \leqq C \leqq 0.15\%$;
- $0.08\% \leqq Mn \leqq 2\%$;
- $Si \leqq 0.040\%$, preferably $\leqq 0.030\%$;
- $Al_{total} \leqq 0.010\%$, preferably $\leqq 0.004\%$;
- $Al_{soluble} \leqq 0.004\%$;
- $0.0050\% \leqq O_{total} \leqq 0.0500\%$, and preferably $\leqq 0.0300\%$;
- $P \leqq 0.20\%$, preferably $\leqq 0.03\%$;
- $S \leqq 0.10\%$, preferably $\leqq 0.03\%$;
- each of the elements Cu, Cr, Ni, Mo, W, Co $\leqq 1\%$, preferably $\leqq 0.5\%$;- each of the elements Ti, Nb, V, Zr≦0.5%, preferably≦0.2%;

each of the elements Sn, Sb, As≦0.1%;

B≦0.1%, preferably≦0.01%;

N≦0.0400%, preferably≦0.0150%;

the remainder being iron and impurities resulting from the production.

The invention relates also to a metallurgical product resulting from the galvanization of the above product.

The invention relates also to a process for obtaining a metallurgical intermediate product, which comprises:

producing in a ladle a liquid steel in which the contents of C, Mn, Si, Al, P, S, Cu, Cr, Ni, Mo, W, Co, Ti, Nb, V, Zr, Sn, Sb, As, B and N are in accordance with those mentioned above, and in which the dissolved oxygen content is maintained between 0.0050 and 0.0500% by the establishment of a chemical equilibrium between the metal and the ladle slag covering it;

and casting said steel on a continuous casting machine.

Said continuous casting machine may be a machine for the continuous casting of slabs in an ingot mold with fixed walls.

Said continuous casting machine may be a machine for the continuous casting of thin strips in an ingot mold with one or more movable walls which follow the product in the course of solidification.

Said machine may, in that case, be a twin-roll casting machine.

The invention relates also to a process for obtaining a metallurgical product of the above type, which comprises:

producing and casting a metallurgical intermediate product using a process as described above, and rolling said intermediate product in the form of a strip.

The invention relates also to a process for obtaining a metallurgical product of the above type, which comprises producing and casting a metallurgical intermediate product in the form of a strip using a machine for the continuous casting of thin strips.

Said strip may subsequently be rolled.

The invention relates also to a process for obtaining a metallurgical product, which comprises producing a strip by one of the above processes and galvanizing said strip.

As will have been understood, there is produced and continuously cast according to the invention a liquid steel whose composition characteristics meet the conditions required for class 1 and 2 steels without aluminum which are to be galvanized. Their casting in the form of intermediate products which can be used for subsequent galvanization is made possible under suitable conditions of cost and safety by the use of either one of these two methods, which, moreover, may be combined:

production of the liquid steel under conditions such that an equilibrium is established between the liquid metal and the ladle slag and imposes a dissolved oxygen content that is sufficiently low to avoid the occurrence of rimming in the ingot mold of the continuous casting machine; that oxygen content must be maintained as far as possible between the ladle and the ingot mold;

casting of the steel in the form of thin strips (generally having a thickness of from 1 to 10 mm) in an installation for casting between two rolls or between two running belts, which is more tolerant towards rimming of the steel than a conventional continuous casting machine having an oscillating ingot mold with fixed walls; it is also possible to use for that purpose an installation for casting on a surface moving in a single direction, such as a running belt or a rotating roll.

The invention will better be understood upon reading the description which follows.

DETAILED DESCRIPTION OF THE INVENTION

In general, the composition of the steel which is to be obtained has the following characteristics (percentages are by weight).

The carbon content is from 0.0005% to 0.15%.

The manganese content is from 0.08% to 2%.

The silicon content is less than or equal to 0.040% (class 2 steel), preferably less than or equal to 0.030% (class 1 steel), in order, as mentioned, to obtain a high deposition rate during the galvanization.

The "total aluminum" content is less than or equal to 0.010%, preferably less than or equal to 0.004%. The content of so-called "soluble" aluminum (that is to say soluble in an acid solution at the moment of analysis of the sample) is less than or equal to 0.004%. These two conditions mean that, at least during the last stages of the production of the steel, the dissolved oxygen content has not been controlled by an addition of aluminum, and that the latter is found in the end product only in the form of traces. In practice, such traces are constituted essentially by aluminum present in the form of alumina in the oxidized inclusions resulting from contact between the metal and the ladle slag.

The total oxygen content is from 0.0050 to 0.0500%, preferably from 0.0050 to 0.0300%. This oxygen content results from the chemical equilibria which have been established in the ladle, during production, between the liquid metal and the ladle slag, from any supply of atmospheric oxygen to the liquid metal which may have occurred between production in the ladle and casting of the metal in the ingot mold, and from the effectiveness of the process of separating off the oxidized inclusions formed during and after production in the ladle. In general, a total oxygen content in the end product of from 0.0050 to 0.0300% is desired, because, above 0.0300%, there is a risk that the mechanical properties of the product will be impaired.

The contents of phosphorus and of sulfur (less than or equal to 0.20% in the case of sulfur, to 0.10% in the case of phosphorus, preferably less than or equal to 0.030%), of copper, chromium, nickel, molybdenum, tungsten, cobalt (less than or equal to 1%, preferably less than or equal to 0.5%), of titanium, niobium, vanadium, zirconium (less than or equal to 0.5%, preferably less than or equal to 0.2%), of tin, antimony, arsenic (less than or equal to 0.1%), of boron (less than or equal to 0.1%, preferably equal to 0.01%) and of nitrogen (less than or equal to 0.0400%, preferably less than or equal to 0.015%) correspond to the most conventional requirements in the case of steels for galvanization.

The other elements present are iron and impurities resulting from the production.

According to a process for the manufacture of a strip or sheet of a steel according to the invention, there is produced in the casting ladle a steel having the above-mentioned contents of C, Mn, Si, P, S, Cu, Cr, Ni, Mo, W, Co, Ti, Nb, V, Zr, Sn, Sb, As, B and N. At the very beginning of the production (for example when casting in the ladle), it is possible to add aluminum in order to catch the majority of the dissolved oxygen present in the liquid steel at the time of filling of the casting ladle. There are thus formed alumina inclusions, which will normally pass into the ladle slag during production. In general, however, no further aluminum will be added during further production, in order to avoid having more than 0.010% of total aluminum and more than 0.004% of soluble aluminum in the end product. Under these conditions, if no aluminum at all is used or if all the aluminum added at the start of production is used up to form aluminum which subsequently separates off almost completely, the content of dissolved oxygen in the liquid steel is controlled either by the carbon, or by the silicon, or by the manganese, or by the last two elements simultaneously. In view of the very low silicon contents of the steel, the deoxidation should in most cases be controlled by the carbon, and this would lead to the formation of CO, which would render the steel "rimmed", with all the disadvantages that this brings at the time of casting, as already mentioned.

According to the manufacturing process of the invention, the steel worker responsible for the production sees to it that, despite its low content, silicon (optionally in association with manganese) is the element that controls the deoxidation. To that end, a chemical equilibrium is established between the metal and the slag covering the liquid steel in the ladle:

- by regulating the composition of the slag in a suitable range;
- and by agitating the liquid metal (by a known method, such as injection of a neutral gas and/or the use of an electromagnetic stirrer) in such a manner as to effect intimate contact between the slag and the metal which repeatedly comes into contact therewith.

With the aid of theoretical models available in the literature, the steel worker is able to determine which slag compositions can allow him to obtain a given dissolved oxygen content, for given Si and Mn contents. He can adjust the composition of the ladle slag by adding lime, silica, alumina and/or magnesia thereto in such a manner as to form a "synthetic slag". To that end, he may carry out chemical analyses of the slag in the course of production, in order to determine which oxides must be added thereto in order to obtain the desired composition. The result of this operation can be checked by measurement of the dissolved oxygen content of the liquid steel, carried out by means of known electrochemical cells. At the end of production, there is obtained a steel whose dissolved oxygen content must be located within the limits specified for the total oxygen content of the steel according to the invention, and the ladle is sent to the continuous casting installation.

By way of example, it can be said that a steel comprising 0.02% Si and 0.8% Mn and brought into equilibrium with a slag composed of 40% CaO, 35% $SiO_2$, 10% MnO, 10% MgO, 5% of various oxides comprises 70 ppm of dissolved oxygen.

Likewise, a steel comprising 0.01% Si and 0.6% Mn and brought into equilibrium with a slag composed of 35% CaO, 35% $SiO_2$, 20% MnO, 10% MgO and various oxides comprises 100 ppm of dissolved oxygen.

During the continuous casting, it is necessary to ensure that the dissolved oxygen content obtained at the end of production in a ladle is not increased too greatly as a result of reoxidations which may occur in contact with the atmosphere. In order to maintain the dissolved oxygen content, several methods, which may be carried out simultaneously, can be proposed:

- continue stirring the liquid steel in the ladle during casting, so as to ensure that the metal-slag equilibrium in the ladle is maintained throughout the casting;
- impart to the covering powder covering the steel present in the casting machine distributor a composition yielding a metal-slag equilibrium which allows the dissolved oxygen content obtained in the ladle to be maintained within the desired limits;
- protect the liquid metal from atmospheric reoxidation as far as possible by exposing it to a non-oxidizing gas (argon, helium, even nitrogen if a relatively high nitrogen content in the final metal is acceptable) until it is introduced into the ingot mold; to that end, non-oxidizing gas can be introduced into the tubes of refractory material protecting the casting jets between the ladle and the distributor and between the distributor and the ingot mold, and/or effect integral housing of the distributor and the non-oxidizing gas injector beneath the cap.

Under these conditions, the liquid steel present in the ingot mold at the moment of casting contains an insufficient dissolved oxygen content to provoke a reaction with the carbon, which would lead to the evolution of considerable CO, with the risk of causing dangerous rimming. The risk of liquid metal overflowing outside the ingot mold is thus avoided.

This operating method is applicable to steels cast continuously in the form of slabs on machines using oscillating bottomless ingot molds with fixed walls. They may be of the conventional type used for casting slabs having a thickness of the order of 20 cm, which are subsequently hot rolled to obtain hot-rolled strips. The latter may then be galvanized and used as such, or they may undergo cold rolling and other thermal or thermomechanical treatments prior to being galvanized.

It is also possible to use for this purpose installations for the casting of thin slabs, in which the thickness of the product leaving the machine is of the order of from 3 to 15 cm, optionally after the product leaving the ingot mold has undergone a liquid core compression operation. The slabs so cast are subsequently hot rolled.

According to another variant of the invention, a liquid steel produced as above is cast on a continuous casting installation of the type having a bottomless casting mold, two large movable walls of which follow the product in the course of solidification. The two principal known processes which satisfy this characteristic are casting between two cooled running belts and casting between two internally cooled rolled having horizontal axes and rotating in opposite directions. The casting space in which solidification of the product takes place is closed off laterally by fixed side walls. Products in the form of strips, generally having a thickness of from 1 to 10 mm, are thus obtained directly and may subsequently undergo hot rolling (optionally on a stand arranged in alignment with the casting installation). The strip may subsequently be used directly, or it may undergo cold rolling and various other conventional thermomechanical treatments.

In the case of the casting of steels according to the invention, which are especially to be galvanized, the use of such an installation for the direct casting of strips is advantageous in that the liquid well present in the ingot mold has a smaller depth than in a conventional continuous casting ingot mold. The bubbles of CO that form in the lower portion of the liquid well are therefore less likely to grow before reaching the surface of the liquid well, and rimming is substantially attenuated in comparison with the rimming which would be observed during casting of the same steel by conventional continuous casting. Moreover, the flared shape towards the top of the casting mold is more suited than the virtually constant cross-section of conventional fixed ingot molds to attenuation of the variations in level caused by rimming. Finally, if the liquid metal does overflow, the consequences are generally less serious than in the case of the conventional continuous casting of slabs, because the elements which are present beneath the ingot mold and which may be reached by the liquid steel are smaller in number and more easily protected. If pores appear in the centre of the strip when it solidifies, it is possible to close them by hot rolling.

As a variation, it is possible to cast the strip on an installation in which the ingot mold comprises only a single movable wall, such as a running belt or a rotating roll. It is thus possible to obtain strip thicknesses less than 1 mm.

It goes without saying that the products according to the invention can be used outside the strict field of galvanization.

The invention claimed is:

1. A process for obtaining a metallurgical intermediate product, which comprises:

producing in a ladle a liquid steel which consists of the following composition by weight:

$0.0005\% \leqq C \leqq 0.15\%$;

$0.08\% \leqq Mn \leqq 2\%$;

$Si \leqq 0.040\%$;

$Al_{total} \leqq 0.010\%$;

$Al_{soluble} \leqq 0.004\%$;

$0.0050\% \leqq O_{total} \leqq 0.0500\%$;

$P \leqq 0.20\%$;

$S \leqq 0.10\%$;

each of the elements Cu, Cr, Ni, Mo, W, $Co \leqq 1\%$;

each of the elements Ti, Nb, V, $Zr \leqq 0.5\%$;

each of the elements Sn, Sb, $As \leqq 0.1\%$;

$B \leqq 0.1\%$; and $N \leqq 0.0400\%$;

and in which the dissolved oxygen content is maintained between said 0.0050 and 0.0500% by the establishment of a chemical equilibrium between the metal and the ladle slag covering it;

establishing said chemical equilibrium by regulating the composition of the slag and agitating the liquid steel; and casting said steel on a continuous casting machine;

wherein said continuous casting machine is a machine for the continuous casting of thin strips, having a thickness in the range of only 1-10 mm, in the ingot mold with one or more movable walls which follow the product in the course of solidification, wherein said machine is continuous casting between two rolls, and wherein the dissolved oxygen is sufficiently low to avoid a rimming of steel in the ingot mold during casting.

2. The process as claimed in claim 1, wherein $Si \leqq 0.030\%$;

$Al_{total} \leqq 0.004\%$;

$0.0050\% \leqq O_{total} 0.0300\%$;

$P \leqq 0.03\%$;

$S \leqq 0.03\%$;

each of the elements Cu, Cr, Ni, Mo, W, $Co \leqq 0.5\%$;

each of the elements Ti, Nb, V, $Zr \leqq 0.2\%$;

$B \leqq 0.01\%$; and $N \leqq 0.0150\%$.

3. A process for obtaining a metallurgical product, which comprises producing a strip by the process as claimed in claim 1 and galvanizing said strip.

4. A process for obtaining a metallurgical intermediate product as claimed in claim 1, which comprises then rolling said intermediate product in the form of a thinner strip.

5. A process for obtaining a metallurgical product, which comprises producing a strip by the process as claimed in claim 4 and galvanizing said strip.

6. A process for directly obtaining a metallurgical product as claimed in claim 1, wherein the casting step further comprises directly producing the metallurgical intermediate product in the form of a strip having a thickness in the range of only 1-10 mm.

7. A process for obtaining a metallurgical product, which comprises producing a strip by the process as claimed in claim 6 and galvanizing said strip.

8. The process as claimed in claim 6, further comprising subsequently rolling said strip.

9. A process for obtaining a metallurgical product, which comprises producing a strip by the process as claimed in claim 8 and galvanizing said strip.

* * * * *